United States Patent [19]

Szasz

[11] 4,278,268

[45] Jul. 14, 1981

[54] SKI BRAKE

[75] Inventor: Tibor Szasz, Vienna, Austria

[73] Assignee: TMC Corporation, Baar, Switzerland

[21] Appl. No.: 74,623

[22] Filed: Sep. 12, 1979

[30] Foreign Application Priority Data

Sep. 19, 1978 [AT] Austria ..... 6739/78

[51] Int. Cl.[3] ..... A63C 7/10

[52] U.S. Cl. ..... 280/605

[58] Field of Search ..... 280/605, 12 AB

[56] References Cited

U.S. PATENT DOCUMENTS

| | | | |
|---|---|---|---|
| 3,715,126 | 2/1973 | Schwarz | 280/605 |
| 3,794,336 | 2/1974 | Sittmann | 280/605 |
| 3,964,760 | 6/1976 | Riedel | 280/605 |

*Primary Examiner*—Joseph F. Peters, Jr.
*Assistant Examiner*—Michael Mar
*Attorney, Agent, or Firm*—Blanchard, Flynn, Thiel, Boutell & Tanis

[57] ABSTRACT

A ski brake having a pedal which is pivotally secured to a mounting member fixedly secured to the upper surface of the ski. The pedal has a pair of elongated and parallel openings extending therethrough along the length of the pedal and parallel to the longitudinal axis of the ski. The pedal is biassed to an upright position by a torsion spring wound around an axle to which the pedal is pivotally secured. Additional torsion springs are provided in the openings in the pedal and brake members are received in the opening and through the central portion of these additional torsion springs therein. These additional torsion springs bias the brake arms so that the brake legs are positioned over the upper surface of the ski and laterally inside of vertical planes containing the side edges of the ski. An operating member, such as a flexible strand, is wound around the brake arms with one end thereof being secured to the brake arms. The other end of the strand is secured to the upper surface of the ski, such as through the mounting member. An erecting of the pedal to the upright position will effect a pulling on the strand and a rotating of the brake arms against the force of the additional torsion springs. Thus, the blade portion of the brake arms will swing outside of the lateral edges of the ski into the braking position.

10 Claims, 9 Drawing Figures

SKI BRAKE

FIELD OF THE INVENTION

The invention relates to a ski brake having at least one, preferably two braking legs, which is or are pivotal by means of a pedal, stepped down upon by a ski boot or by a sole plate, about an axis which extends substantially at a right angle with respect to the longitudinal axis of the ski from a working position (braking position) against a spring force into a retracted position (downhill skiing position).

BACKGROUND OF THE INVENTION

A ski brake of the above-mentioned type is described for example in Austrian Pat. No. 303 944 or in the associated U.S. Pat. No. 3,715,126 (FIGS. 7 to 9). The braking legs are pivotally arranged in this conventional construction on the shafts of a yoke, which shafts serve as a support for the braking legs and extend parallel with respect to the longitudinal axis of the ski, however, the shafts of the braking bar remain both in the retracted position and also in the braking position of the conventional ski brake above the upper surface of the ski and only the arms of the braking legs which serve as braking blades are moved, during a pivoting of the ski brake from the retracted position into the braking position, laterally outside of the two ski edges. In order to guide the arms of the braking legs during a pivoting of the brake from the retracted position into the braking position beyond the ski edges, ski-fixed guide blocks are associated with each braking leg and cooperate with sloped regions on each arm of the braking legs. Furthermore, the braking arms are hinged through two extensions to the associated shaft, wherein in the retracted position of the ski brake a pair of the extensions rests on a stop arranged on the base plate, in order to prevent a rattling of the device during skiing. It can be seen that this brake consists of many structural parts, thus the manufacture is associated with high manufacture and material expenses and the product itself is susceptible to trouble. A further disadvantage is that during a pivoting of the ski brake from the retracted position into the braking position or vice versa, not only the braking legs and the yoke, but the entire housing must be pivoted, which operation results automatically in the use of a stronger and thus also more expensive spring. Finally, the housing is pivoted in the braking position of the ski brake to the base plate, wherein the yoke is positioned practically perpendicular with respect to the upper surface of the ski. It can easily be seen that a stepping into a ski binding, which is equipped with such a brake, is cumbersome.

The invention has now the purpose of providing a ski brake of the above-mentioned type such that together with a pivotally supported plate only the position of the braking blades is changed, when the ski brake is swung from the braking position into the retracted position or vice versa.

The set purpose is inventively attained by each braking leg being biassed by a torsion spring which urges said braking leg into the retracted position, and by a rope, band, a cord or the like being secured to the periphery of each braking leg and guided by each braking leg in a direction toward the upper surface of the ski and is held down in a, possibly common, ski-fixed mounting at least against a lifting off in a vertical direction (away from the upper surface of the ski), wherein its one subrange can be wound up on the associated braking leg.

Due to the fact that each braking leg is held biassed by a torsion spring in direction of the retracted position, the rope, the band, the cord or the like is rolled up at the periphery of each braking leg to a length which corresponds with the spacing between the upper surface of the ski or a mounting member and the area of the pedal of the ski brake, through which the rope, the band, the cord or the like is guided in direction toward the mounting member. The force of the torsion spring is thereby dimensioned such that it assumes only a secure swinging of the braking legs from the braking position into the retracted position, wherein not only the friction which occurs during the swinging operation, but also the force which is needed for winding up the rope, the band, the cord or the like is produced. The spring force which is needed to swing the ski brake from the retracted position into the braking position is, however, dimensioned so strongly, that it not only effects a secure erecting of the ski brake, but simultaneously overcomes the sum of the force of the two torsion springs. In this manner, it is assured that while the ski brake is swung from the retracted position into the braking position, the individual braking legs are loaded by the operating members (rope, band, cord or the like) associated therewith—against the force of the individual torsion springs—are swung out to an earlier determined angular extent, preferably approximately at 90°, so that the surfaces of the braking blades, which are provided on the free ends of the individual braking legs, are active in direction of the braking. In other words: in the retracted position, the individual braking blades extend with their active surfaces substantially perpendicularly with respect to the upper surface of the ski; in the braking position they extend substantially at a right angle with respect to the longitudinal axis of the ski. The position which in the retracted position is identified as "substantially perpendicularly" includes here and hereinafter each angle at which the individual blades lie inside the lateral edges of the ski associated therewith; they can—if this is necessary and is not prevented neither by the ski binding parts nor by the ski boot—also rest on the upper surface of the ski. This measure is also important for the invention.

BRIEF DESCRIPTION OF THE DRAWINGS

Further characteristics, advantages and details of the invention are described in more detail with reference to the drawings, which illustrate one exemplary embodiment.

FIGS. 1 and 3 are each a side view and FIGS. 2 and 4 are each a top view.

DETAILED DESCRIPTION

Figure 1:
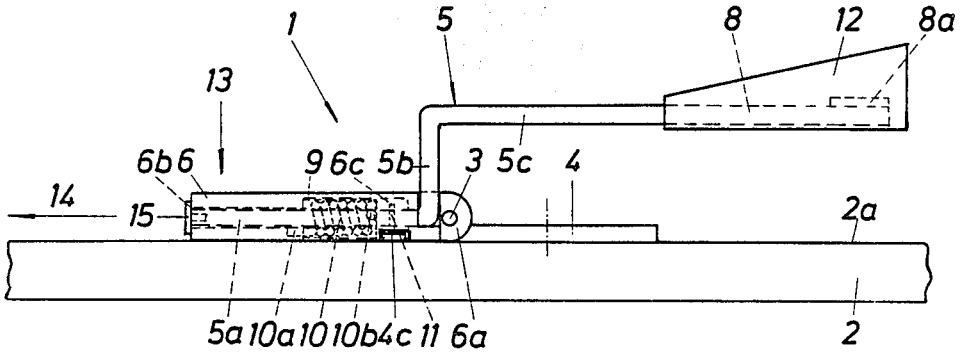
FIGS. 1 and 2 are associated views of a ski brake in the retracted position.

A ski brake which is identified as a whole by the reference numeral 1 is pivotally supported about the axis of an axle 3 on the upper surface 2*a* of a ski 2 by means of a ski-fixed mounting member 4. The axle 3 is supported in bearing tabs 4*a* of the mounting member 4. A plate 6, which can be operated as a pedal of the ski brake 1 by means of a ski boot (not shown) or a sole plate (both indicated by an arrow 13), is pivotally supported on the axle 3 on the one side by means of two bearing blocks 6a, which are preferably constructed of the same material as is the plate 6. The plate 6 is, in the present exemplary embodiment, constructed of a plastic material; it can also be reinforced with a metal insert or metal attachment. The ski brake 1 is biassed by a torsion spring 7, which is wound around the axle 3 and is supported with its one end on the upper surface 2a of the ski and with its other end on the plate 6.

Figure 3:
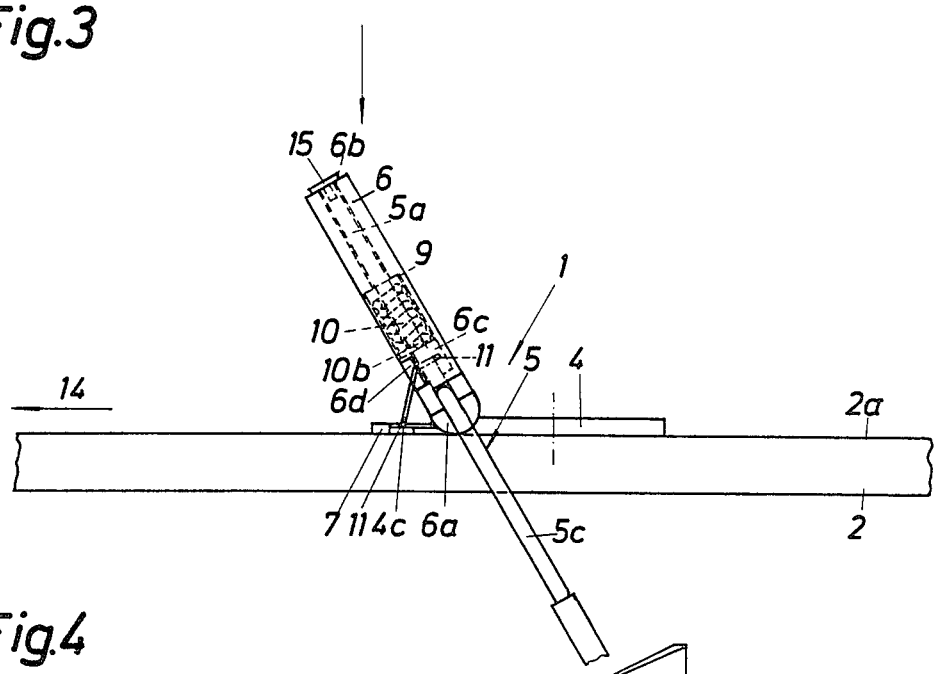
FIGS. 3 and 4 illustrate the ski brake according to FIGS. 1 and 2 in the braking position, whereby
Figure 4:
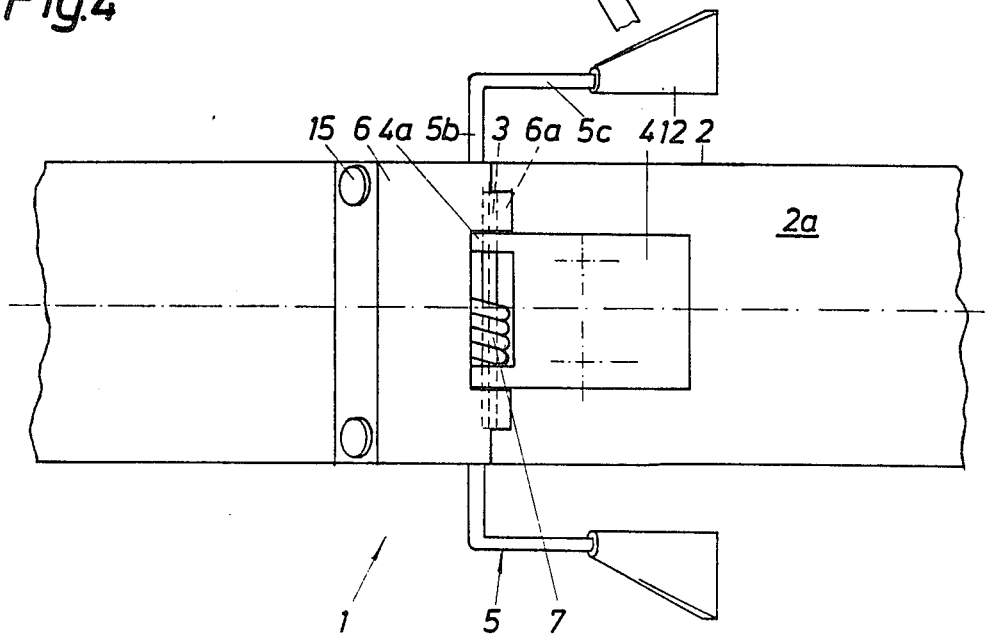

The plate 6 has at each of its two sides an elongated opening 6b, the axis of which extends in the retracted position of the ski brake 1 parallel with respect to the longitudinal axis of the ski 2. Each first end segment 5a of a braking leg 5, which consists of a multiply bent wire having a circular cross section, is inserted into the individual openings 6b of the plate 6. This first end segment is followed by a bent wire segment 5b, which extends in the retracted position of the ski brake (see FIG. 1) substantially perpendicularly with respect to the upper surface 2a of the ski, which wire segment passes over through a further bent segment into a wire segment 5c which extends substantially parallel with respect to the upper surface 2a of the ski, the free end of which segment 5c is constructed as a braking spur 8. Each braking spur 8 carries a braking blade 12 thereon which preferably consists of a plastic material and which is secured against rotation by an extension or key 8a of the braking spur 8. Thus the position of each braking blade 12 in relationship to the braking leg, with which it is associated, is clearly determined. By comparing the position of the ski brake 1 according to FIGS. 1 and 2 on the other hand and according to FIGS. 3 and 4 on the other hand, the operation of the braking legs, braking spurs or braking blades will clearly be recognized. In the retracted position of the ski brake 1, the two braking legs lie with the associated braking spurs or braking blades inside the vertical planes containing the two ski edges; in the braking position of the ski brake 1, however, they are rotated at approximately 90°, so that the two braking blades 12 are active with their braking surfaces. The ski brake 1 can be effective also when one or both braking blades are lost, as might happen in particular on iced-up slopes. In the case of powdery snow, in particular in deep snow, the braking action is less in this case, because the length of the brake path, depending on the condition of the slope, is extended in an undesired manner. An unhindered, free run of the now detached ski is, however, also in this case prevented.

Figure 2:
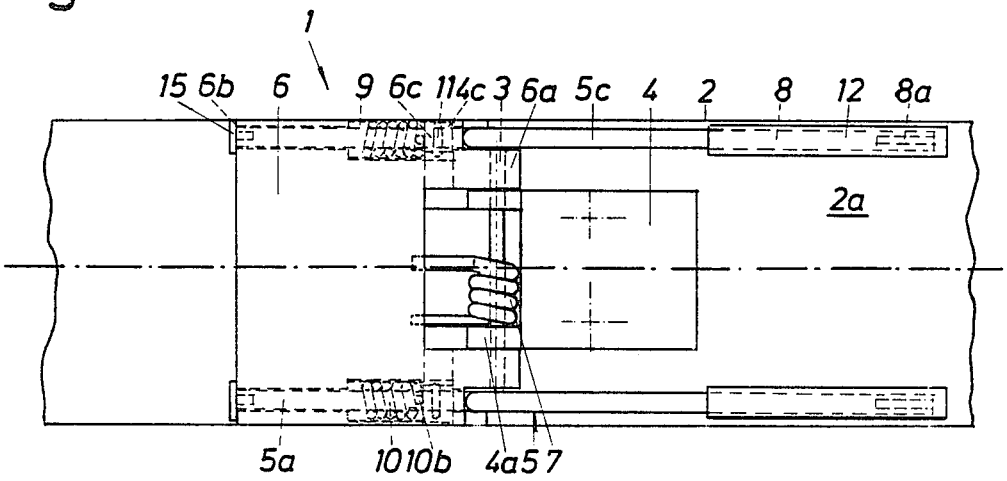

To swivel the individual braking legs 5, the following observations are made. Each recess 6c is provided in the underside of the plate 6 in the region of the individual wire segments 5a of the two braking legs 5, in which each torsion spring 10 is arranged. The one end 10a of each torsion spring 10 is fixedly inserted into the material of the plate 6 and the other end 10b is secured in or on the wire segment 5a of each braking leg 5. Each torsion spring 10 is thereby under such initial tension that the individual braking legs 5 assume the position which is shown in FIGS. 1 and 2 and which corresponds with the retracted position of the ski brake 1.

Each wire segment 5a of the two braking legs 5, which segment 5a is associated with the plate 6, can further be loaded by a structural part which is generally identified as an operating member, which member may be a rope, a band, a cord or the like. The operating member is constructed in the present exemplary embodiment as a rope 11, is separately fastened on each braking leg segment 5a, is guided through a recess 6d in the plate 6 and is secured to a holding part 4c of the mounting member 4. Each rope 11 is, in the retracted position of the ski brake 1, wound up on the periphery of the braking leg segment 5a, since each braking leg is swung by a stepping down onto the plate 6 by means of a not shown ski boot or by means of an also not shown sole plate (in direction of the arrow 13) and by the action of the individual torsion springs 10 into the retracted position shown in FIGS. 1 and 2. If, however, the ski brake 1 is freed voluntarily or automatically by removal of the ski boot (now shown) or of the sole plate (also not shown), for example during a fall, then the ski brake 1 is swung through the action of the strong torsion spring 7 from the retracted position illustrated in FIGS. 1 and 2 into the braking position illustrated in FIGS. 3 and 4. Since the rope 11 is fastened in or on the mounting member 4 and its length is dimensioned as needed, these ropes 11 cause each braking leg 5 to be swung, as already described, about 90° (toward the outside) against the force of the torsion spring 10 which loads said braking leg 5.

The now described inventive measure has the important advantage over conventional ski brakes in that the structural parts which are needed for swinging in or out are separate (on the one side the two torsion springs 10 and on the other side the operating members 11), so that such a structural part always need only to fulfill the task assigned to it, through which the optimum action of the individual structural parts can be achieved. The circumstance, that the torsion spring 7 has to also overcome the force of the two torsion springs 10 is of no importance, because the force of the torsion spring 7 which effects the braking must be designed for a safe braking capability.

To fasten the individual braking leg segments 5a in the plate 6, the free ends of the same can be secured on the plate 6 by means of holding pins, holding screws or the like 15. Such designs are actually known for the man skilled in the art and, therefore, do not need to be discussed any further. For the closed support of the individual torsion springs, a sleeve 9 may be arranged in each recess 6c of the plate 6. It is easily understandable that, in this case, the rope 11 is also guided through a corresponding opening in the sleeve 9.

The invention is not limited to the illustrated exemplary embodiment. A number of modifications, which by all means lie within the scope of the invention, exist. For example, the torsion spring can also be designed as a straight torsion spring, the one end of which—just as in the case of the described wound torsion spring—is secured in the material of the plate 6, however, the other end of which engages the second wire segment 5b.

A further also inventive modification can consist in the operating member, a rope, a band, a cord or the like being constructed as a single structural part and said structural part is guided through below the mounting member 4. This embodiment has the advantage that only two free ends need to be fastened to the individual braking leg segments 5a. A still further inventive measure consists in the operating member 11 being guided along a groove, slot, or the like, which groove, slot, or the like is arranged along a helix on the braking leg segment 5a or on the periphery of the sleeve 9, which in this case is swingable together with the associated braking leg 5. This embodiment has the advantage that the thickness of the rope, band, the cord or the like 11 gives the designer lower limits with respect to the dimension of the diameter of the braking leg segment 5a or the diameter of the sleeve 9.

To secure the individual braking legs on the plate 6, it is inventively possible to rivet the end of each braking leg segment 5a which extends through the plate 6 to the plate 6. The length of the braking leg segment 5a is in this case to be dimensioned corresponding with this manner of operation. A different type of fastening consists inventively in the region of each opening 6b, which region is associated with the free end region of said braking leg segment 5a of a tapped hole, in which a thread on the free end part of the individual braking leg segments 5a is in engagement. Since each braking leg 5 is rotated only at 90°, a falling out of the individual braking legs by a loosening up process is impossible. However, it can be preferable in this case, which embodiment is also important for the invention, to insert into the individual openings 6b of the plate 6 a metal sleeve having a tapped hole therein, to prevent a wearing away of the plastic material. It can easily be understood that in this case, the metal sleeve is positioned nonrotatably in the plate for example by means of a forced fit.

Figure 5:
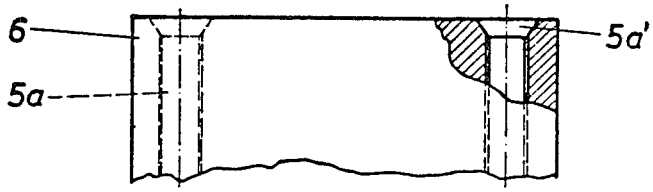
FIGS. 5 to 9 show some details.

According to FIG. 5, the free ends 5a' of each braking leg segment 5a are pivoted against movement in longitudinal direction of the plate 6.

Figure 7:
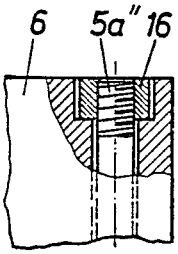
Figure 6:
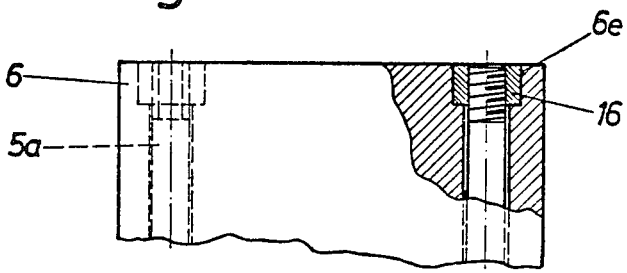

FIGS. 6 and 7 show a threaded connection of each braking leg segments 5a. According to the FIG. 6 the free ends 5a'' of the individual braking leg segments 5a are provided with a thread, and wherein the end regions of the individual braking leg segments 5a are screwed into tapped holes provided in outwardly extending regions 6e of the individual openings of the plate 6, wherein the tapped holes are provided in the plate preferably in a metal sleeve 16, which metal sleeves in turn are inserted into openings and are held therein by a forced fit. However, as shown in FIG. 7, the metal sleeve 16 can be inserted into the associated opening with a clearance so that the opening can be drilled therein for each individual braking leg segment 5a''.

Figure 8:
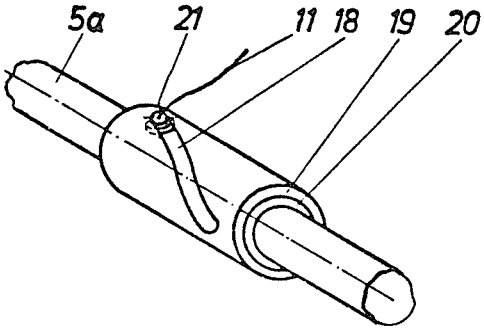
Figure 9:
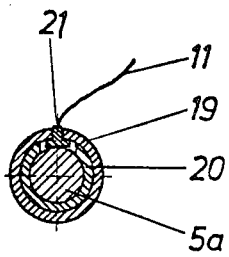

FIGS. 8 and 9 show the connection of the operating member 11 in a slot 18 of a metal sleeve 19. The operating member 11 is held in the slot 18 by means of a nipple 21 which is slidably arranged in the slot 18 and held by a spacer member 20 which maintains a central positioning of each leg segment 5a in the metal sleeve 19.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A ski brake, comprising:

base plate means adapted to be mounted on an upper surface of a ski;

pedal means pivotally secured to said base plate means and pivotal between a first position generally parallel to said upper surface of said ski and a second position inclined at an angle to said upper surface of said ski;

first resilient means for continually urging said pedal means toward said second position;

means defining at least one bearing opening in said pedal means;

brake blade means rotatably mounted in said bearing opening and being movable between first and second locations, said brake blade means comprising a first wire segment rotatably received in said bearing opening, a second wire segment, in said first location thereof, extending generally parallel to the longitudinal axis of and above said upper surface of said ski when said pedal means is in said first position, said second wire segment being offset from said first wire segment and, in said second location thereof, extending alongside of a lateral edge of said ski and projecting below the under surface of said ski when said pedal means is in said second position, and a third wire segment connecting said first and second wire segments;

second resilient means for urging said brake blade means toward said first location thereof; and connecting means coupled to said brake blade means and said base plate means for effecting a movement of said brake blade means toward said second location against the urging of said second resilient means and in response to a movement of said pedal means toward said second position under the urging of said first resilient means.

2. The ski brake according to claim 1, including a pair of said brake blade means, one each on opposite sides of said ski, wherein said pedal means includes a pair of said openings, each rotatably receiving a first wire segment therein, wherein said second resilient means includes a pair of torsion springs, each encircling a respective one of said first wire segments with one end thereof being coupled to a respective one of said first wire segments and the other end thereof being coupled to said pedal means, and wherein said connection means includes a pair of connecting elements, each effecting a movement of a respective one of said brake blade means toward a second location therefor against the urging of the respective one of said second resilient means and in response to a movement of said pedal means toward said second position under the urging of said first resilient means.

3. The ski brake according to claim 1, wherein said opening in said pedal means includes a section housing said second resilient means therein.

4. The ski brake according to claim 1, wherein said connection means comprises an elongated flexible strand secured at one end to said first wire segment and at the other end to said base plate means, said flexible strand being wound up onto said first wire segment when said pedal means is in said first position, whereby as said pedal means moves from said first position toward said second position, said flexible strand will effect a rotating of said brake blade means and simultaneously unwind from said first wire segment, all against the urging of said second resilient means.

5. The ski brake according to claim 4, wherein said bearing opening in said pedal means includes a section for housing said flexible strand wound up on said first wire segment, said pedal means including further means defining a passageway through which extends said flexible strand toward said connection to said base plate means, said passageway also receiving therein a part connecting said flexible strand to said base plate means.

6. The ski brake according to claim 1, including securement means for preventing an axial movement of said first wire segment relative to said bearing opening.

7. The ski brake according to claim 6, wherein said first wire segment extends generally parallel to said longitudinal axis of said ski when said pedal means is in said first position, an end of said first wire segment remote from said third wire segment having said securement means thereon.

8. The ski brake according to claim 7, wherein said securement means includes a threaded end segment on said first wire segment and a threaded sleeve member fixedly secured to said pedal means, said threaded end segment being threadably coupled to said threaded sleeve member.

9. The ski brake according to claim 7, wherein said securement means includes an enlargement fastened to and located adjacent said end of said first wire segment.

10. The ski brake according to claim 1, wherein said connection means comprises an elongated flexible strand secured at one end to said base plate means and at the other end to a slide member, said first wire segment having a sleeve therearound with an elongated slot extending along a helix, said slot slidably receiving said slide member therein.

* * * * *